US006716318B2

(12) United States Patent
Watanabe

(10) Patent No.: US 6,716,318 B2
(45) Date of Patent: Apr. 6, 2004

(54) PAPERMAKING PRESS FELT

(75) Inventor: Kazumasa Watanabe, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 10/237,890

(22) Filed: Sep. 9, 2002

(65) Prior Publication Data

US 2003/0051848 A1 Mar. 20, 2003

(30) Foreign Application Priority Data

Sep. 14, 2001 (JP) ..... 2001-279817

(51) Int. Cl.[7] ..... D21F 3/00; B32B 5/06

(52) U.S. Cl. ..... 162/358.2; 162/900; 442/183; 442/286; 428/133; 428/134; 428/137

(58) Field of Search ..... 162/306, 348, 162/358.2, 358.1, 358.3, 358.4, 900–904; 139/383 A, 383 AA, 425 A; 428/131–140, 141, 156, 124; 28/110; 442/50, 57, 183, 268, 270–275, 286–294

(56) References Cited

U.S. PATENT DOCUMENTS 4,446,187 A * 5/1984 Eklund ..... 428/136
4,500,588 A * 2/1985 Lundstrom ..... 428/212
4,806,413 A * 2/1989 Penven ..... 428/222
4,830,905 A 5/1989 Gulya et al.
5,056,565 A * 10/1991 Kufferath ..... 139/383 A
5,372,876 A 12/1994 Johnson et al.
5,445,746 A * 8/1995 Lee ..... 210/783
6,159,880 A * 12/2000 Schiel ..... 442/270

FOREIGN PATENT DOCUMENTS

JP 3-8888 1/1991

* cited by examiner

*Primary Examiner*—Steven P. Griffin
*Assistant Examiner*—Eric Hug
(74) *Attorney, Agent, or Firm*—Howson and Howson

(57) ABSTRACT

A papermaking press felt having excellent rewetting suppression without impaired water-squeezing capability, comprises a base body, batt layers, and a rewetting prevention layer, integrated with one another by needle punching. The rewetting prevention layer has three dimensional passages comprising a verge opening, a wet paper web side opening and a roll side opening. The wet paper web side opening is larger than the roll side opening. Under nip pressure, water from the wet paper web moves into the roll surface side of the felt, passing through the passages in the rewetting prevention layer. Although a rewetting phenomenon tends to occur when the press felt is released from the nip pressure, movement of water through the passages back to the wet paper web side of the felt is suppressed since the roll side openings are narrower than the wet paper web side opening.

8 Claims, 11 Drawing Sheets

FIG.12

| | Re-wetting prevention layer 40 | Needle 50 | Opening 44 | Air permeability | Water content at press exit I (%) | Water content at press exit II (%) | I − II (%) | Evaluation of re-wetting phenomenon |
|---|---|---|---|---|---|---|---|---|
| Example-1 | Biaxially oriented film made of nylon | R of Ball point 51; 0.09mm | Funnel-shaped | 6cc/ $cm^2$/sec | 48.2 | 48.0 | 0.2 | ○ |
| Example-2 | Ditto | R of Ball point 51; 0.075mm | Funnel-shaped | 5cc/ $cm^2$/sec | 48.3 | 48.0 | 0.3 | ○ |
| Example-3 | Ditto | R of Ball point 51; 0.05mm | Funnel-shaped | 5cc/ $cm^2$/sec | 48.5 | 48.1 | 0.4 | ○ |
| Comparative example-1 | None | R of Ball point 51; 0.09mm | | 15cc/ $cm^2$/sec | 50.0 | 47.5 | 2.5 | × |
| Comparative example-2 | Axial extension film made of nylon | R of Ball point 51; 0.09mm | Openings are connected mutually | 10cc/ $cm^2$/sec | 50.0 | 48.0 | 2.0 | × |
| Comparative example-3 | Spun bond made of nylon | R of Ball point 51; 0.09mm | Hole having the same diameter as the needle is punched flatly | 5cc/ $cm^2$/sec | 50.0 | 47.6 | 2.4 | × |

PAPERMAKING PRESS FELT

FIELD OF THE INVENTION

This invention relates to a felt which is used in a press section of a papermaking machine, and more particularly to a papermaking press felt (hereinafter called a "press felt") having an improved water squeezing capability.

BACKGROUND OF THE INVENTION

As shown in FIG. 13, a conventional press apparatus, used to squeeze water from a wet paper web in a papermaking process, comprises a pair of press rolls P, and a pair of press felts 12, which pinch a wet paper web W. When the press felts 12 and the wet paper web W are compressed between the press rolls P, water is squeezed from the wet paper web W and absorbed by the press felts 12.

Each of the press felts 12 comprises a base body (not shown) for maintaining strength, and batt layers (not shown) which are provided on both sides of the base body. The base body is integrated with the batt layers by needle punching.

FIG. 14, which is a partial, enlarged view of the press nip in FIG. 13, illustrates the movement of water which is squeezed from a wet paper web W. It does not illustrate the detailed structure of the press felts 12, however.

When the press rolls P rotate in the direction of the arrows in FIG. 13, the press felts 12 and the wet paper web W, which are sandwiched between the press rolls P are propelled in through the press nip in the direction of the arrows in FIG. 13.

As mentioned above, when the press felts and the wet paper web W are compressed, water is squeezed from the wet paper web W and absorbed in the press felts 12. However, within a short distance from the nip center to the delivery side of the rolls, the pressure applied to the wet paper web W and press felts 12 is rapidly released, and the volumes of the press felts 12 and the wet paper web W expand rapidly. As the expansion occurs, a pressure is applied to the press felts 12. Moreover, since the wet paper web is made of thin fiber, a capillary phenomenon also occurs. As a result of the pressure applied to the felts and the capillary action in the wet paper web, water which was absorbed in the press felts 12 shifts again to the wet paper web W. The phenomenon just described is known as the rewetting phenomenon, and is a problem in a conventional press apparatus. U.S. Pat. No. 5,372,876 discloses a felt designed to prevent rewetting. As shown in FIG. 15, in the felt 11, which comprises a base body 31 and batt layers 21 on both sides of the base body, a hydrophobic film 41, which is made of spunbonded filaments, is provided on the base body 31. This hydrophobic film 41 divides the felt into a press roll side layer and a wet paper web side layer. Even if pressure applied to the felt 11 is released rapidly, it is difficult for water which is absorbed in the press roll side layer to move to the wet paper web side layer. Accordingly, this felt 11 is supposed to be capable of suppressing rewetting.

Unexamined Japanese Patent Publication No. 8888/1991 discloses a felt in which a barrier layer which comprises a porous film is provided so that water absorbed in the barrier layer is prevented from moving to the wet paper web side.

In addition, U.S. Pat. No. 4,830,905 discloses a press felt in which a foam layer having independent bubbles is provided to prevent rewetting by holding water in the bubbles.

However, with the hydrophobic film having many small holes, and the porous film, used in the felts disclosed in U.S. Pat. No. 5,372,876 and Unexamined Japanese Patent Publication No. 8888/1991, suppressing the movement of water is difficult in practice, and good rewetting suppression may not be achieved.

U.S. Pat. No. 4,830,905 does not disclose how the water held in the bubbles is discharged, and accordingly there is a doubt about the practical effect of the press felt described therein.

The invention solved the above-mentioned problem by providing a papermaking press felt which has a wet paper web contacting surface and a roll contacting surface, the felt comprising a base body, a batt layer, and a rewetting prevention layer, in which the rewetting prevention layer has three-dimensional passages, each said passage comprising an opening rim, a wet paper web side opening and a roll side opening, the wet paper web side opening being larger than the roll side opening.

According to the invention, a rewetting prevention layer having passages with a three-dimensional structure prevents rewetting effectively.

BRIEF DESCRIPTION OF DRAWINGS

FIG. 12 is a table of experimental results;

DETAILED DESCRIPTION OF THE PREFERRED EMBODIMENTS

Figure 1:
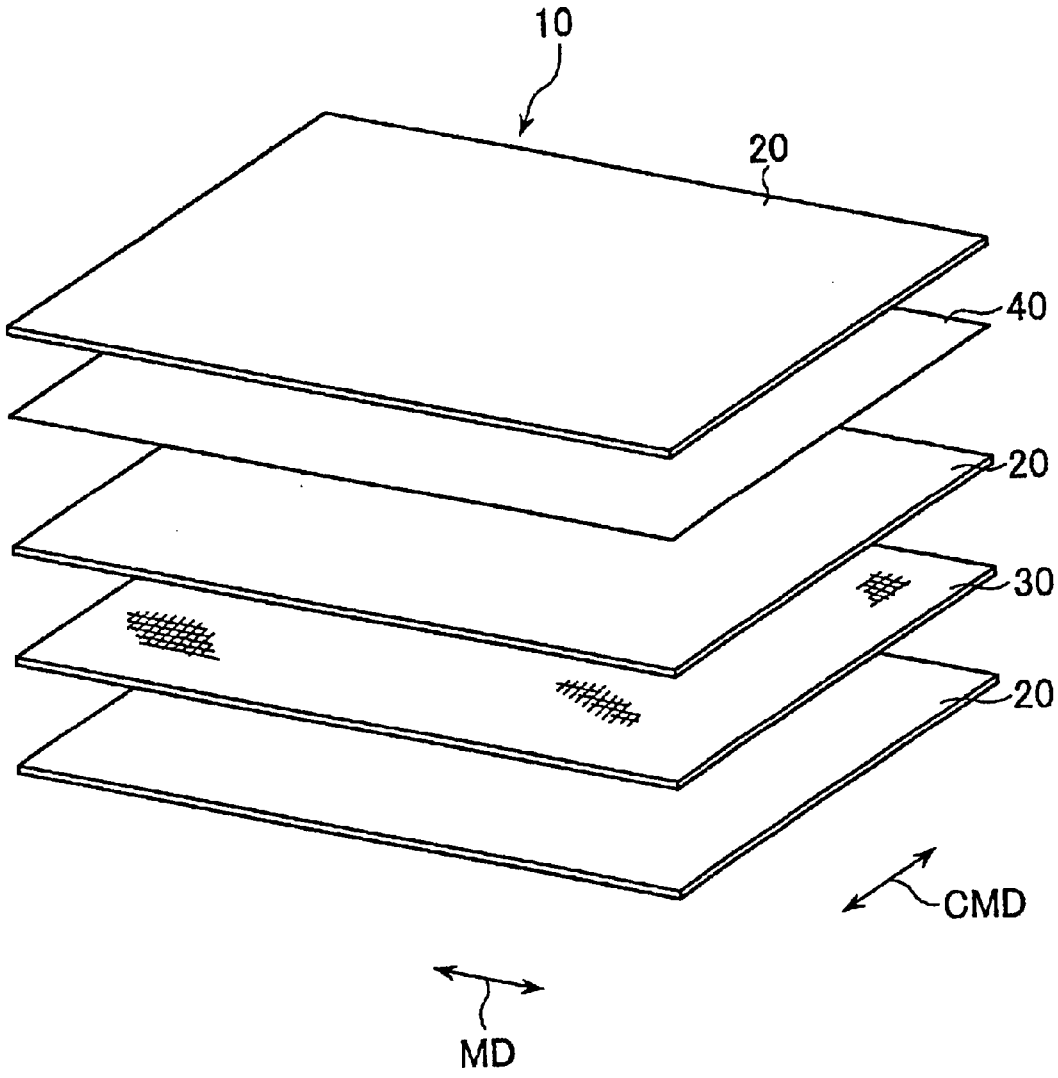
FIG. 1 is an exploded perspective view of a press felt according to the invention.
Figure 2:
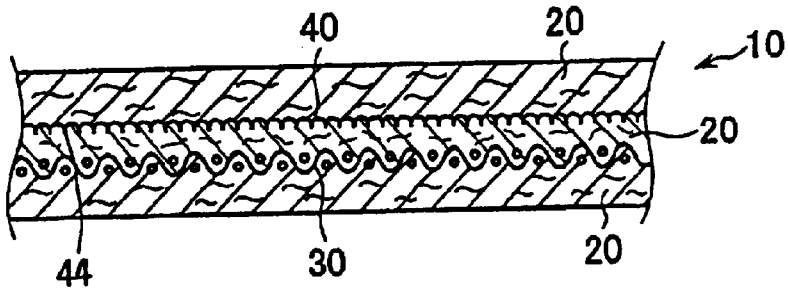
FIG. 2 is a cross-sectional view of a press felt according to the invention.

Referring to FIGS. 1 and 2, press felt 10 comprises a base body 30, and batt layers 20 which comprise short fiber and a rewetting prevention layer 40 to be described below. The layers are intertwined by needle punching to form an integrated press felt.

The base body 30 is provided to impart strength to the press felt. The material of the base body may be a woven fabric or a belt-shaped body composed of yarns which are not woven.

In the base body 30 and the batt layers 20, natural fibers such as wool, or synthetic fibers such as nylon 6, nylon 66, etc. which are superior in wear resistance, fatigue resistance, extension characteristics and stain resistance, are used.

In the press felt 10 of FIG. 1, a batt layer 20 is provided between the rewetting prevention layer 40 and the base body 30. However, in an acceptable alternative, the rewetting prevention layer 40 and the base body 30 can be in direct contact with each other.

Figure 3:
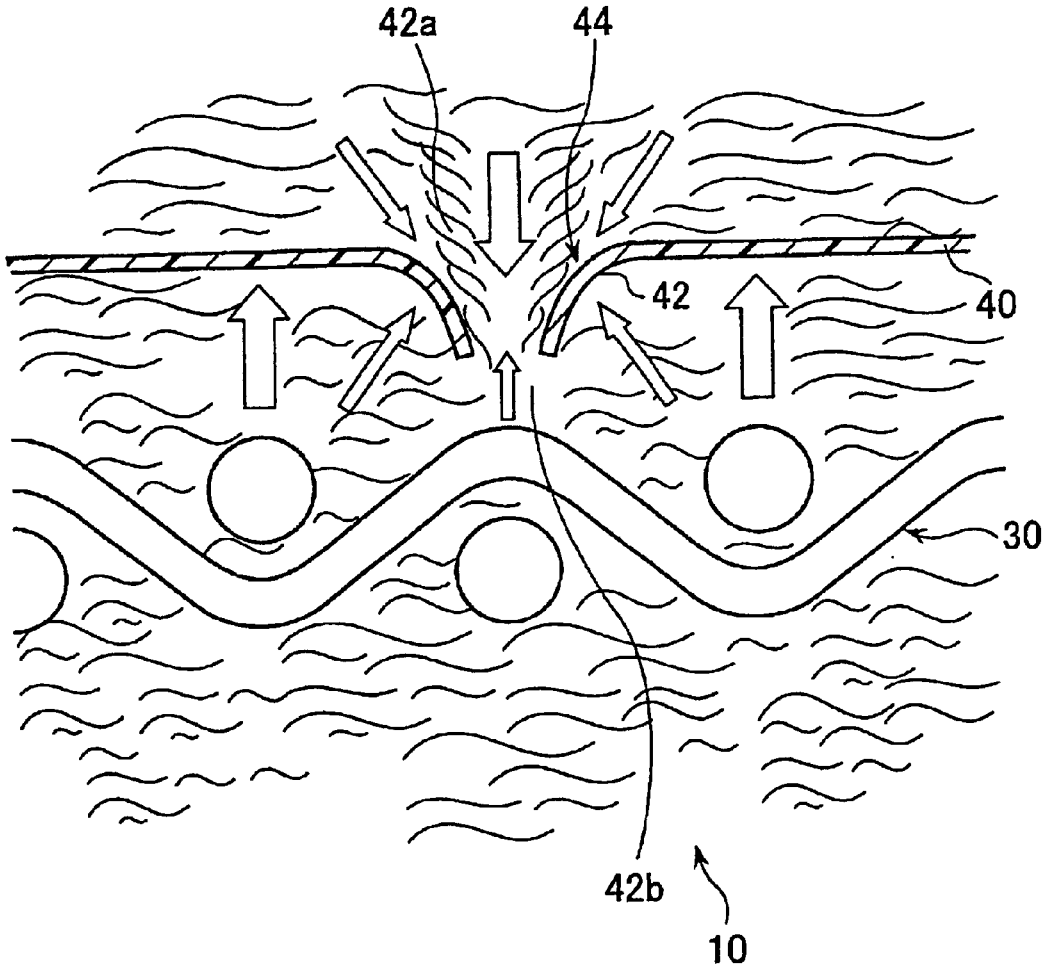
FIG. 3 is an enlarged cross-sectional view of the main part of a press felt according to the invention.

As shown in FIG. 3, which is an enlargement of a part of FIG. 2, passage 44 is one of many passages provided in the rewetting prevention layer 40. Passage 44 is funnel-shaped so that its wet paper web side opening 42*a* is larger than its press roll side opening 42*b*.

The rewetting prevention layer 40 comprises a thin film, originally without holes, and is attached to the main body of the felt 10 by needle punching, whereby short fibers of the batt are inserted through the film.

As the fibers of the batt layer are inserted into the rewetting prevention layer 40 by needle punching, the passage 44 is produced, and a rim 42 of the opening protrudes downward. Thus, the passage 44 has a three-dimensional structure, in which the rim 42 has the roll side opening 42*b* formed at its lower end, and the wet paper web side opening 42*a* formed at its upper end. The inclination of the wall of the rim 42 causes the wet paper web side opening 42*a* to be larger than the roll side opening 42*b*.

A biaxially oriented film is suitable for use as a rewetting prevention layer 40. Films exhibiting low water absorption, such as polyethylene, polypropylene, polyvinylidene and polyester, and also water-absorbing films such as nylon and polyurethane, may be used as a film material.

The rewetting prevention layer preferably comprises a material which has an extension characteristic similar to that of the base body or the batt layer in order to match the extension characteristics of components of the felt 10, and thereby improve its heat resistance when it is subjected to heating in the felt manufacturing process. As mentioned previously, nylon is frequently used for the batt layer 20 and the base body 30 of a papermaking press felt 10. Where nylon is used to form the batt layer and/or the base body, the film is also preferably made of nylon.

In the case of a rewetting prevention layer 40 made of nylon, experiments have established that a preferred rewetting prevention layer is one having a thickness in the range of 10 to 30 $\mu$m, a tensile strength in the range from 1 to 15 kg/cm in the length and breath directions respectively, and a fracture elongation in the range of about 50% to 200% was preferable.

In FIG. 3, arrows show the directions of movement of water in the operation of the press felt when carrying a wet paper web through the nip of a press roll. Water from the wet paper web moves into the press felt 10 as a result of the nip pressure. The water squeezed from the surface of the felt passes through the passage 44 in the rewetting prevention layer 40, and moves to the roll surface side. The water flows smoothly through the passage 44, since the passage is tapered.

After an area of the press felt 10 passes through the nip, and the nip pressure is released on that area, so that rewetting would ordinarily occur, water moving toward the roll side of the press felt is intercepted by the rewetting prevention layer 40, and flow of water through the passage 44 is suppressed. No water flows through the layer 40 where there is no passage 44, and, since the roll side opening 42*b* is narrower than the wet paper web side opening 42*a*, water does not pass readily through the passage 44 in the direction from the roll side toward the web side.

Figure 4:
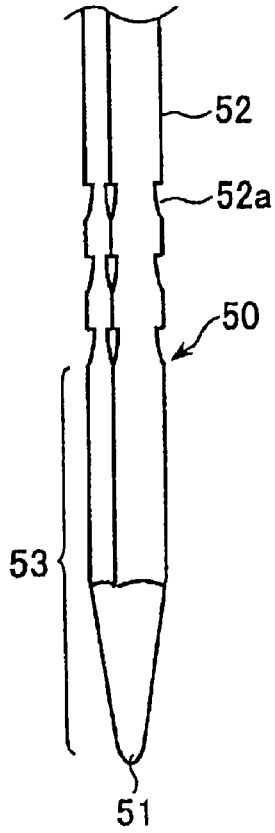
FIG. 4 is an enlarged view of the point of a needle used for manufacturing a press felt according to the invention.

A preferred process for producing an passage 44 in a rewetting prevention layer will be explained with reference to FIGS. 4 and 5(A)–5(E). FIG. 4 is an enlarged view of the point of a needle 50 used in the manufacturing process and FIGS. 5(A)–5(E) show the successive stages of the punching operation in which an opening is produced in the rewetting prevention layer.

When a papermaking press felt 10 according to the invention is manufactured, a good result may be obtained if a needle 50 which has a ball point 51 shown in FIG. 4 is used. This ball point 51 is formed in a spherical shape at the point of the needle 50. It has been confirmed by experiment that the spherical part of ball point 51 preferably has a radius in the range from 0.05 mm to 0.09 mm.

Usually, the main body of the needle 50 is polygon-shaped in transverse cross section, and barbs 52*a* for catching and pushing short fibers are formed along corners 52 of the polygon. In accordance with the invention, since it is necessary to push large amounts of short fiber into the rewetting prevention layer 40, and the wet paper web side opening 42*a* should be made large, a good result may be obtained by providing barbs 52*a* along two or more corners 52. In FIG. 4, the needle 50, which is triangular in transverse cross-section, has barbs 52*a* formed along all three corners 52.

The length of the portion 53 of the needle 50, extending from the point 51 to the barb 52*a* nearest to the point 51, is called the "point length."

Figure 5A:
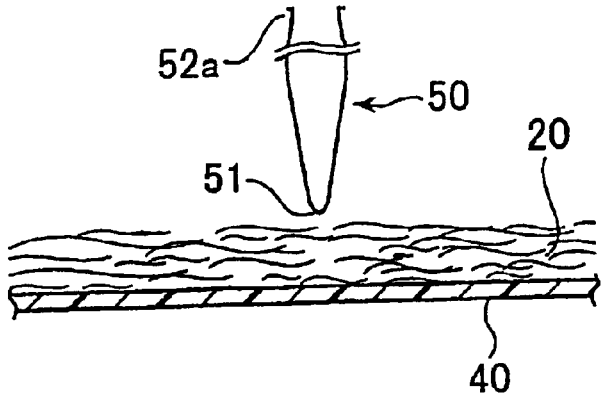
FIGS. 5(A)–5(E) are enlarged explanatory views showing the process of forming the opening in a rewetting prevention layer of a press felt according to the invention.
Figure 5B:
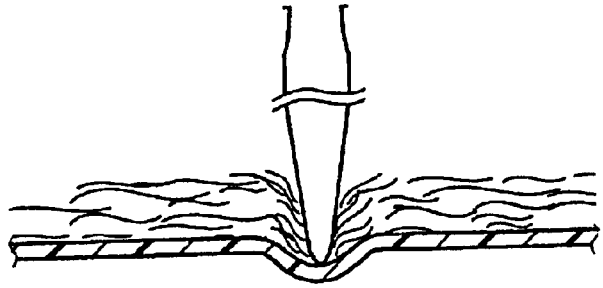

In the process illustrated in FIGS. 5(A)–5(E), as shown in FIG. 5(A), a layer of short fibers is placed on the rewetting prevention layer 40. A needle 50 is driven into the upper part of the layer of short fibers. The ball point 51 of the needle 50 passes through the short fibers and reaches the rewetting prevention layer 40 as shown in FIG. 5(B). Since the area of ball point 51 which comes into contact with the rewetting prevention layer 40 is large, the needle 50 does not punch the rewetting prevention layer 40 immediately, but instead depresses the layer 40 downward at first.

Figure 5C:
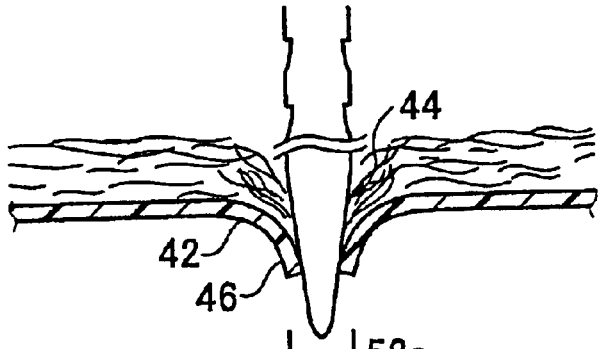

When the needle 50 advances, the rewetting prevention layer 40 is ruptured to form a hole, as shown in FIG. 5(C). As a result, the roll side opening 42*b* is formed. As described later, the part which is ruptured is depressed downward as the needle 50 advances, forming a cylindrical opening 46, conforming to the shape of the point length portion 53 of the needle.

Figure 5D:
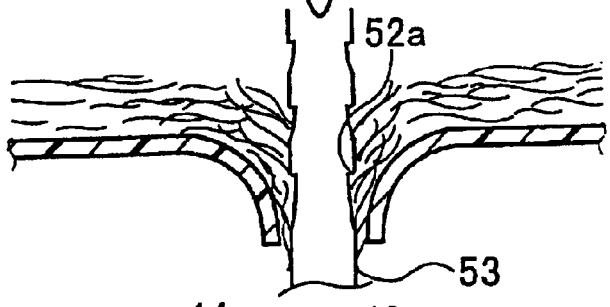
Figure 5E:
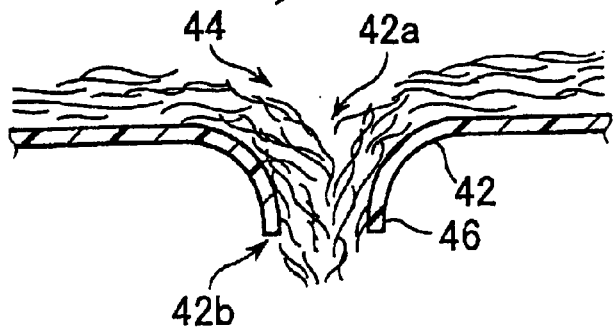

As shown in FIG. 5(D), as the point length portion 53 of the needle 50 advances, the barb 52*a* catches short fibers and pushes them below the rewetting prevention layer 40 . If the barbs 52*a* are provided in two or more corners 52, more short fiber are pushed downward. As a result of the movement of the short fibers, a depressed and inclined opening rim 42 is formed in the rewetting prevention layer 40. In this way, as shown in FIG. 5(E), a passage 44, in which the wet paper web side opening 42*a* is larger than the roll side opening 42*b*, is formed in the rewetting prevention layer 40.

After the needle 50 is depressed to a prescribed position, it is moved up again. The rewetting prevention layer 40 is then moved horizontally through a prescribed distance, and the needle 50 again moves downward so that short fibers are driven into the rewetting prevention layer 40. This operation is repeated until the desired pattern of passages is formed.

In this connection, since the short fibers which are moved into the passage 44 are fixed in the passage, the passage is never shut. As a result, a three-dimensional passage structure is maintained after the needling operation is completed.

In this way, the passage 44 is formed in the re-wetting prevention layer 40. When a biaxially oriented film is used for this re-wetting prevention layer 40, a large split, caused by the impact of punching, in the re-wetting prevention layer 40 and the opening rim 42 around the wet paper web side opening 42*a*, may be prevented, and thus the passage 44 may be prevented from being united with each other, which will result in the film rupture.

The needling process is carried out by causing a needle board (not shown), having many needles 50, to reciprocate up and down. It is acceptable to drive the short fibers into the rewetting prevention layer 40, and to form the openings 44, by means of needles 50 all of which are of the same kind and of the same thickness. On the other hand, it is also possible to provide a needle array in which needles of various kinds are arranged on a single needle board according to control parameters such as air permeability, etc. in order to achieve a desired performance in the papermaking felt.

For instance, when the objective is to secure air permeability, additional needles can be provided on the same needle board together with needles 50 having ball points 51 and barbs 52*a* formed on all corners 52. The additional needles may be thicker than the other needles, and may have sharp points and barbs only on one corner. In this case, three dimensional passages 44, which have a wet paper web side opening 42*a* larger than the roll side opening 42*b*, are provided along with additional openings (not shown) which are larger than this passage 44 and of generally configuration. With this felt structure, rewetting is reduced to an extent while good air permeability is provided.

Figure 6:
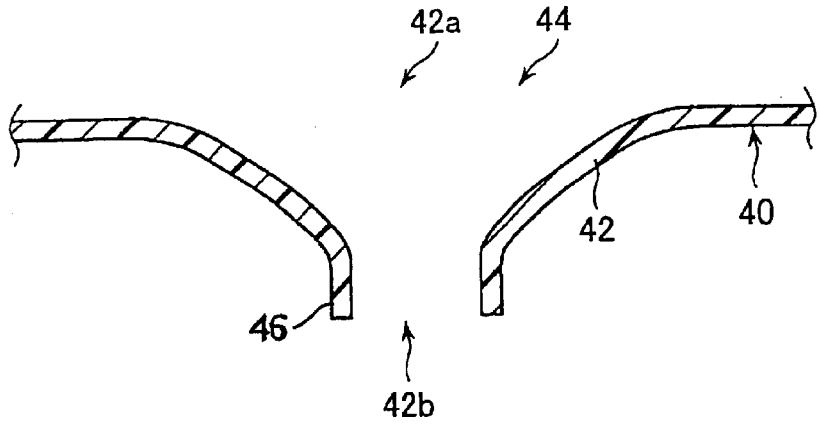
FIGS. 6(A) and 6(B) are enlarged cross-sectional views showing different embodiments of the opening in a rewetting prevention layer of a press felt according to the invention.
Figure 6:
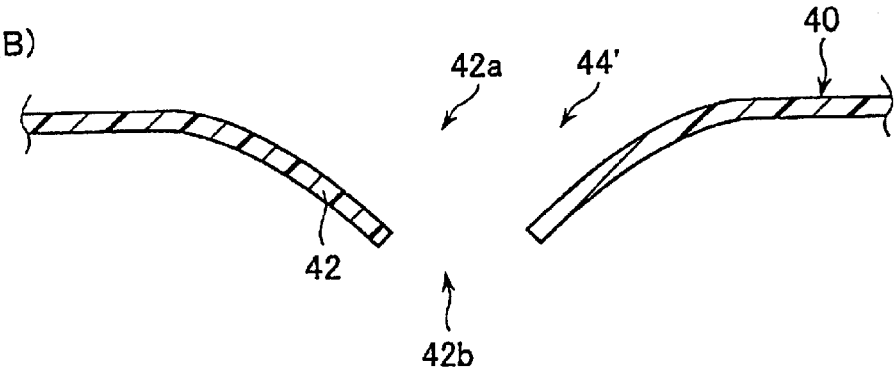

As shown in FIGS. 6(A) and 6(B), a rewetting prevention layer 40 having a passage 44 is provided. For forming the passages 44 of FIGS. 6(A) and 6(B), barbs 52*a* are provided along all corners 52 of each needle 50.

A passage 44, formed by a needle 50 having a ball point 51, is shown in FIG. 6(A). A cylindrical opening 46 is formed at the inner edge of the opening rim 42 by the needle 50 as described above. Since the passage 44 as a whole has a funnel shape, it easily prevents infiltration of water from the roll side opening 42*b*.

FIG. 6(B) depicts a passage 44' formed by a needle 50 which has the usual sharp point rather than a ball point 51. Although the short fibers drawn by barbs 52*a* into the rewetting prevention layer 40 form an inclined passage rim 42, no cylindrical opening corresponding to opening 46 in FIG. 6(A) is formed. The passage of FIG. 6(A) is inferior in its rewetting prevention ability to a passage 44 having a cylindrical opening 46. However, it may be adopted when improved productivity is important.

When the rewetting prevention layer 40 is arranged on a bed of short fibers, and a short fiber bed is arranged on the rewetting prevention layer 40, and needle punching is carried out, the opening rim 42 inclines and protrudes downward more easily since the rim 42 of the passage is supported by the short fiber bed on the lower side of the rewetting prevention layer 40. The impact of needle punching is eased by the lower short fiber bed, and, as a result, rupture of the rewetting prevention layer 40 occurs more reliably. Thus, if needle punching is carried out with a short fiber bed arranged on the lower side of the rewetting prevention layer 40, passages 44, in which the wet paper web side openings 42*a* are larger than the roll side openings 42*b*, may be manufactured more easily.

The process of manufacturing the overall press felt 10 according to the invention will now be explained. The following are examples of a large variety of alternative manufacturing processes.

A short fiber bed is arranged on a base body 30, and both are integrated by needle punching. Then, the base body 30 is turned upside down. In this situation, the base body 30, and a batt layer 20 on the roll side, have been already formed.

The wet paper web side is formed next, and methods for forming the wet paper web side can be divided roughly into two general patterns, either of which may be adopted. According to the first pattern, a rewetting prevention layer 40 and a short fiber bed are accumulated on a base body 30 sequentially, and are integrated with the base body 30 by needle punching. According to the second pattern, a bed of short fibers is provided on a rewetting prevention layer 40 and, by integrating the fiber bed with the rewetting prevention layer by needle punching, a preparation layer 60 is obtained. The preparation layer 60 is then arranged on a base body 30, and the preparation layer and base body are integrated by needle punching.

To obtain a press felt in which a batt layer 20 is formed between the rewetting prevention layer 40 and the base body 30, after placing a short fiber bed on the base body 30, the rewetting prevention layer 40, or the preparation layer 60, is placed on the short fiber bed.

The method of placing a rewetting prevention layer 40 or a preparation layer 60 on a base body 30 will be explained with reference to FIGS. 7–9. In each case, the rewetting prevention layer 40, or the preparation layer 60, is provided on a material roll 70, and the base body is stretched between stretch rolls 80.

Figure 7:
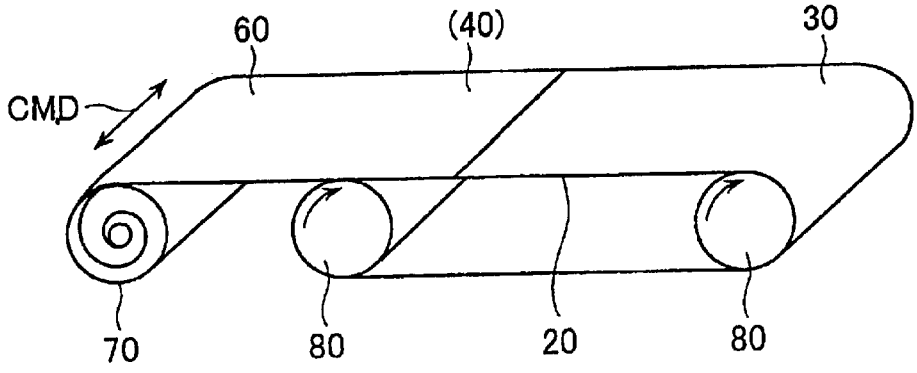
FIG. 7 is a perspective view showing a process for manufacturing a press felt according to the invention.

In the manufacturing method shown in FIG. 7, the rewetting prevention layer 40, or preparation layer 60, has the same width in the cross machine direction (CMD) as the base body 30. A leading edge of the rewetting prevention layer 40, or preparation layer 60, is first fixed on the base body 30. The layer 40 or 60 is drawn from the material roll 70 as the base body 30 moves around stretch rolls 80. After the layer 40 or 60 is placed on the base body 30, it is severed at almost the same position at which the leading edge is fixed to the base body 30, and the severed end is also fixed on the base body.

Figure 8:
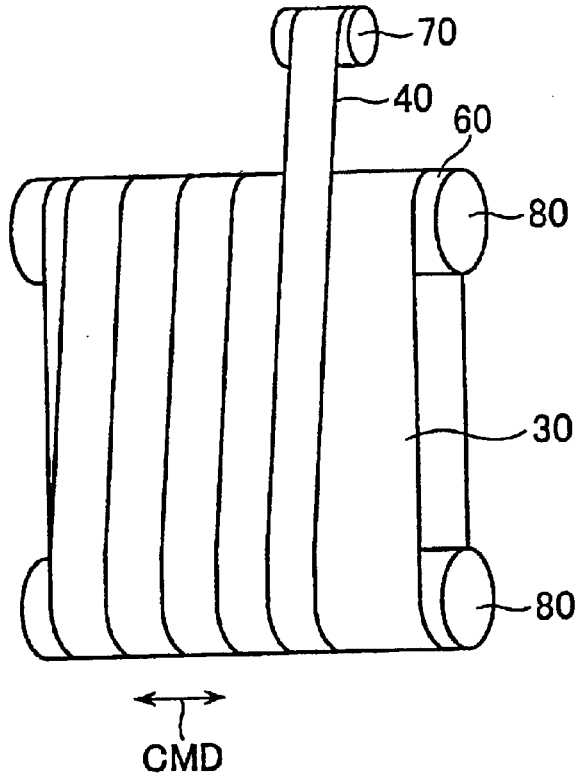
FIG. 8 perspective view showing another process for manufacturing a press felt according to the invention.
Figure 9:
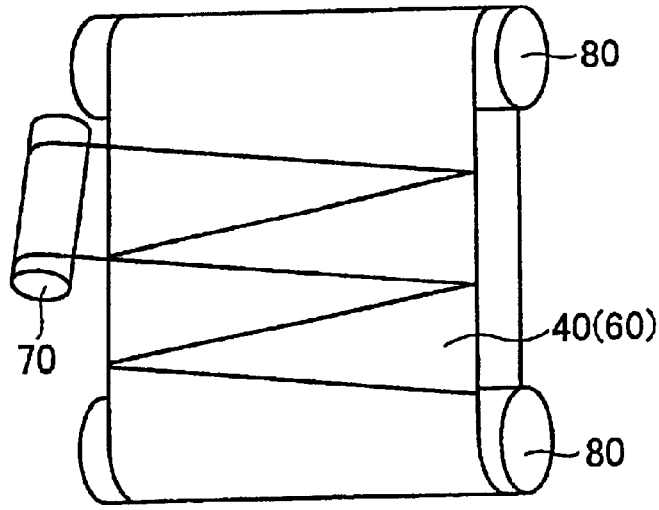
FIG. 9 is a perspective view showing still another process for manufacturing a press felt according to the invention.

FIGS. 8 and 9 show manufacturing methods in which the rewetting prevention layer 40 has a width less than that of the base body 30 in the cross machine direction.

As shown in FIG. 8, the rewetting prevention layer 40, or preparation layer 60, is rolled onto the base body 30 at a small angle relative to the machine direction so that it is wound onto the base body in a spiral.

Alternatively, as shown in FIG. 9, the layer 40 or 60 may be arranged so that its lengthwise direction is at a small angle relative to the cross machine direction of the base body 30. In this case, it is preferable not to use the preparation layer 60, and instead to place only the rewetting prevention layer 40 on the base body. With the longitudinal direction of the rewetting prevention layer 40 disposed at an appropriate small angle relative to the cross machine direction of the base body 30, layer 40 is placed on the base body so that a length of layer 40 extends from a first edge of the base body to the other edge. Then, the rewetting prevention layer 40 is folded and is placed on the base body so that it extends toward the first edge. This operation is repeated until the rewetting prevention layer 40 covers the whole surface of the base body 30, and the folding angle is selected accordingly. In this case, the rewetting prevention layer 40 is securely fixed on the base body 30 by the weight of the folding part in the end of the base body 30.

As mentioned above, although a film without holes may be used to form the rewetting prevention layer 40, it is also possible for the rewetting prevention layer 40 to have a structure with improved air permeability depending on the desired characteristics of the papermaking felt. In this case, the holes for improving air permeability of the layer 40 may be punched preliminarily in the layer by the use of needles.

Experiments were conducted to confirm the effects of the papermaking press felt according to the invention. For the experiments, a basic structure was adopted for all the felts so that the various conditions were common to the examples in accordance with the invention, and comparative examples. A base body (a plain weave of nylon monofilament twine) had a basis weight of 300 g/m$^2$. A batt layer (short fibers of nylon 6) had a total basis weight of 550 g/m$^2$. The needle punching density was 700 times/cm$^2$ The needles each had a ball point 51 is at the point, a triangular cross-section, and barbs 52*a* formed along all the corners 52.

EXAMPLE 1

The rewetting prevention layer 40 was composed of a biaxially oriented film made of nylon. The radius of the ball point 51 of the needles was 0.09 mm. The opening 44 was funnel-shaped. Air permeability was 6 cc/cm$^2$/sec.

EXAMPLE 2

The rewetting prevention layer 40 was composed of a biaxially oriented film made of nylon. The radius of the ball point 51 of the needles was 0.075 mm. The opening 44 was funnel-shaped. Air permeability was 5 cc/cm$^2$/sec.

EXAMPLE 3

The rewetting prevention layer 40 was composed of a biaxially oriented film made of nylon. The radius of the ball point 51 of the needles was 0.05 mm. The opening 44 was funnel-shaped. Air permeability was 5 cc/cm$^2$/sec.

Comparative Example 1

No rewetting prevention layer 40 was used. The radius of the ball point 51 of the punching needles was 0.09 mm. Air permeability was 15 cc/cm$^2$/sec.

Comparative Example 2

A rewetting prevention layer 40 was composed of an axial extension film made of nylon. The radius of the ball point 51 of the needles was 0.09 mm. Tears in the direction of the film extension were present to a marked extent, and the openings were mutually connected to one another Air permeability was 10 cc/cm$^2$/sec.

Comparative Example 3

The rewetting prevention layer 40 was a spun bond layer made of nylon. The radius of the ball point 51 of the needles was 0.09 mm. The punched openings were flat and of the same thickness as the needles. Air permeability was 5 cc/cm$^2$/sec.

Figure 10:
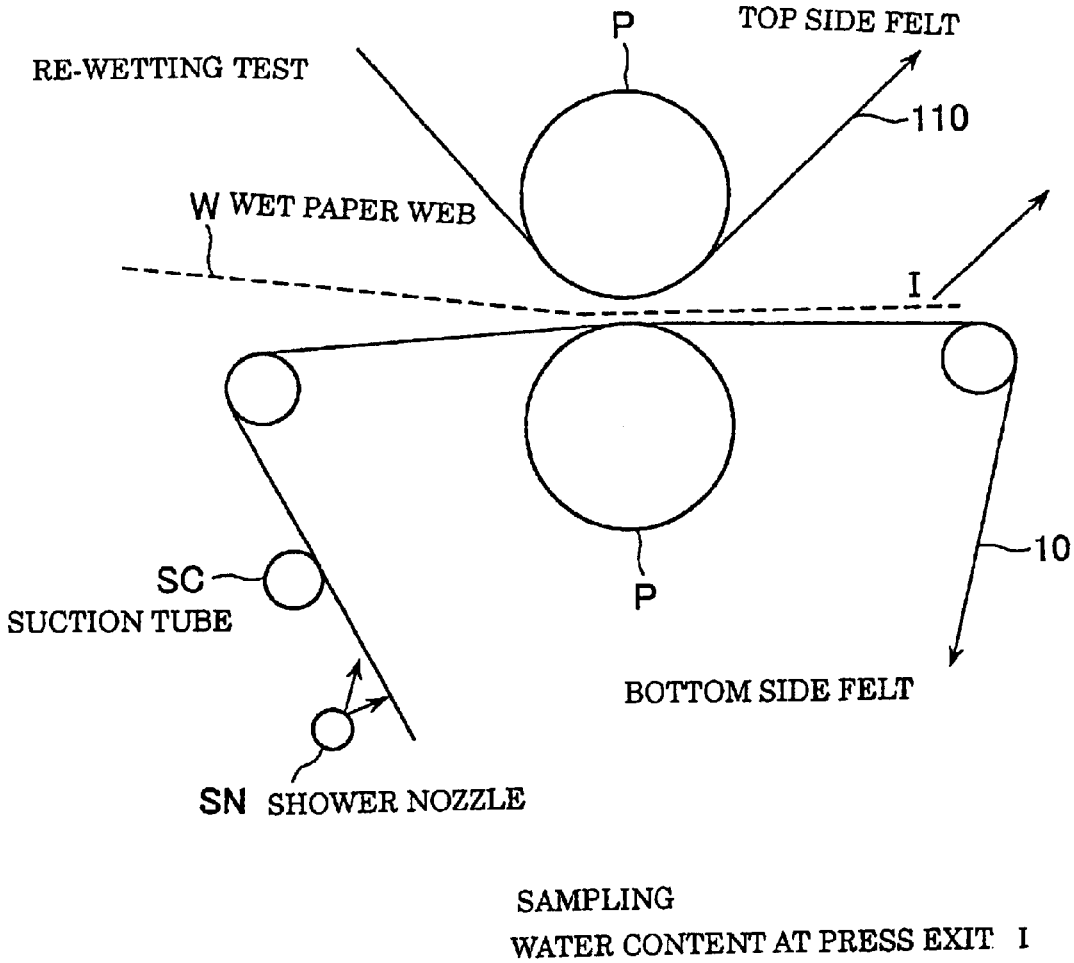
FIG. 10 is a schematic view of an apparatus for confirming the effect of a press felt according to the invention.
Figure 11:
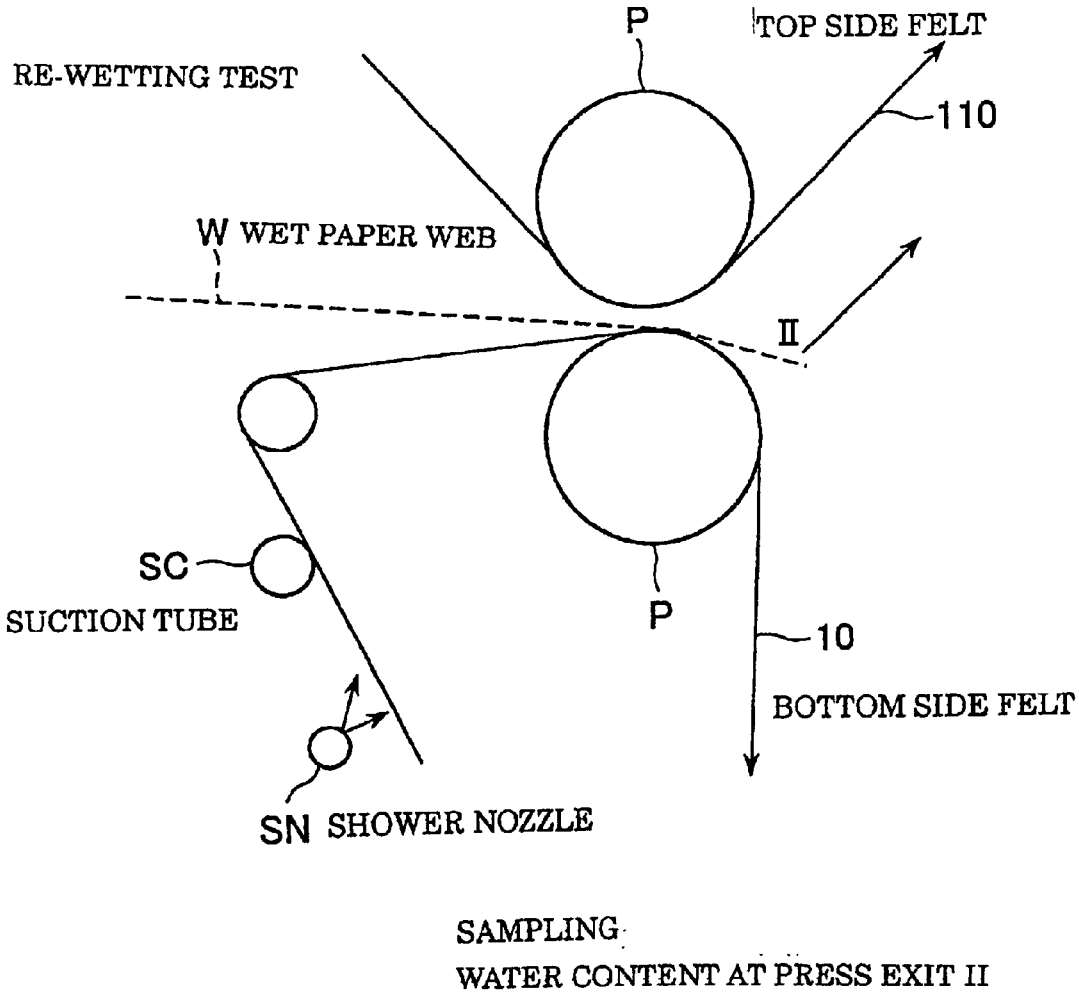
FIG. 11 is a schematic view of another apparatus for confirming the effect of a press felt according to the invention.
Figure 13:
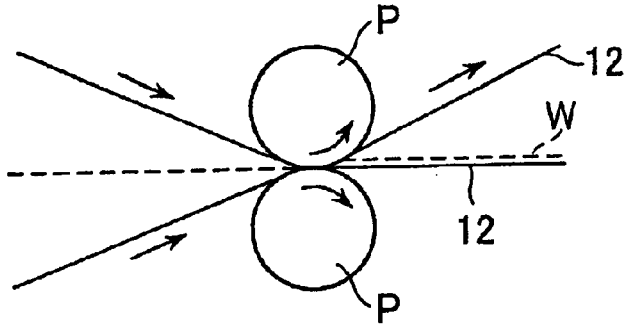
FIG.13 PRIOR ART
FIG. 13 is a schematic explanatory view of a press apparatus in a papermaking machine.
Figure 14:
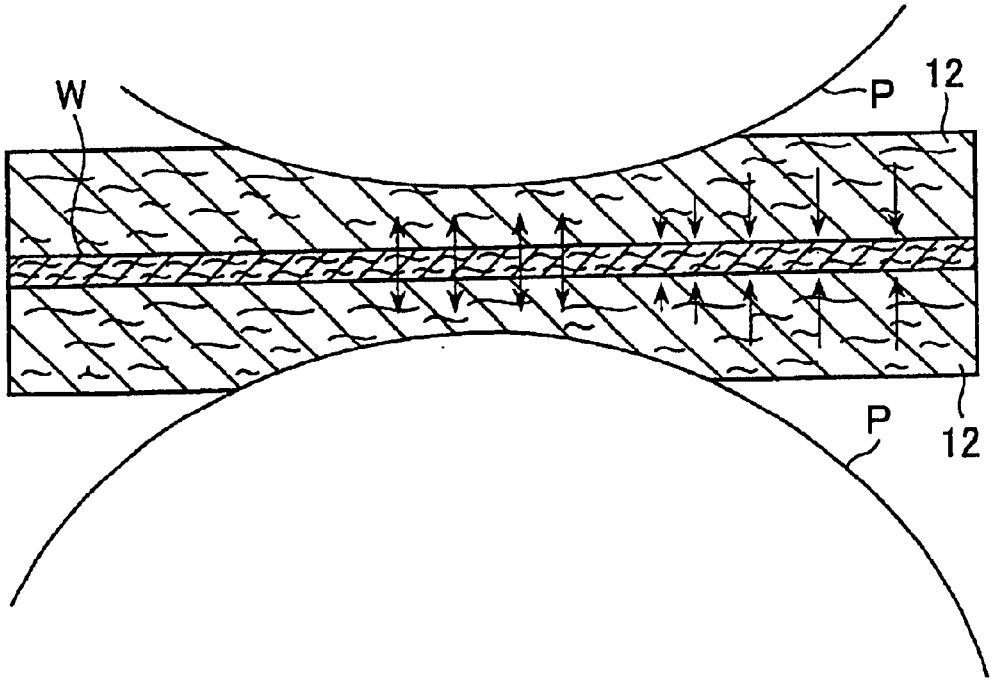
FIG.14 PRIOR ART
FIG. 14 is an explanatory view illustrating the movement of water in a wet paper web.
Figure 15:
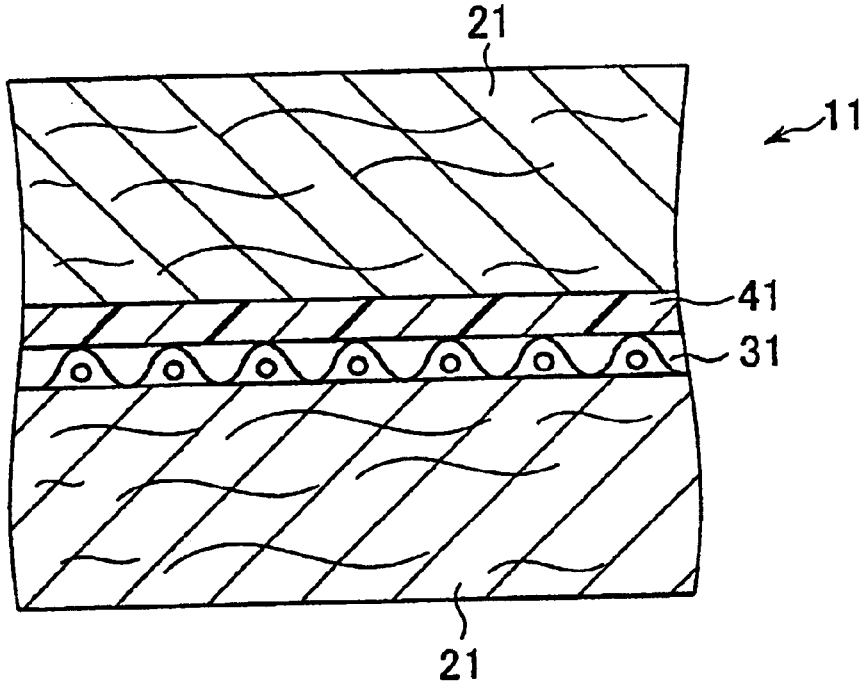
FIG.15 PRIOR ART
FIG. 15 is a cross-sectional view of a conventional press felt.

After above-mentioned papermaking press felts were prepared, experiments were conducted, using the two apparatuses shown in FIGS. 10 and 11, in each of which P is a press roll, 110 is a top side felt, 10 is a bottom side felt, SC is a suction tube, and SN is a shower nozzle.

The felt of each of the examples was used as a bottom side felt 10. In each case, the top side felt 110 was the same as described above in connection with Comparative example 1.

Both apparatuses shown in FIGS. 10 and 11 had a running speed of 500 m/min and a press pressure of 100 kg/cm$^2$.

In the apparatus shown in FIG. 10, when the wet paper web is released from the nip pressure, it is placed on the bottom side felt 10 and transferred. Therefore, if the water content of the wet paper web is measured at a distance from the press exit, i.e., the position at which it is released from the nip pressure, data on the water content of the wet paper web after rewetting may be obtained.

On the other hand, in the apparatus shown in FIG. 11, a larger area of the bottom side felt 10 is in contact with the lower press roll, and the wet paper web is in contact with felts 10 and 110 after release from the nip pressure only for a very short time. So, if the water content of the wet paper web is measured at the press exit, data on the water content of the wet paper web, in which rewetting has occurred to a lesser degree, may be obtained. Accordingly, the degree of rewetting in a given felt can be evaluated by comparing the water content in identical felts passing through the two apparatuses.

The difference between data on the water content in the apparatus shown in FIG. 10 and the water content in the apparatus shown in FIG. 11 was obtained, and an evaluation of the rewetting phenomenon was conducted. If the difference between the measured water content in a given belt using one apparatus and the measured water content in an identical belt using the other apparatus, was 0.5% or less, it was judged that a rewetting phenomenon did not occur. On the other hand, if the difference was more than 0.5%, it was judged that rewetting had occurred.

A summary of the experimental results is shown in FIG. 12. As shown in FIG. 12, it has been confirmed that the papermaking press felts according to the invention exhibit excellent suppression of the rewetting phenomenon.

As mentioned above, the invention makes it possible to provide a papermaking press felt which has a comparatively simple structure and good rewetting suppression.

What is claimed is:

1. A papermaking press felt which has a wet paper web contacting surface and a roll contacting surface, comprising a base body, a batt layer, and a rewetting prevention layer, said layers being connected to one another and movable together as a unit, in which said rewetting prevention layer has three-dimensional passages, each said passage comprises an opening rim, a wet paper web side opening and a roll side opening, said wet paper web side opening being larger than said roll side opening.

2. A papermaking press felt as claimed in claim 1, in which the rewetting prevention layer also has a plurality of planar openings.

3. A papermaking press felt as claimed in claim 1, wherein said each said three-dimensional passage has a cylindrical part, and is funnel-shaped.

4. A papermaking press felt as claimed in claim 3, in which the rewetting prevention layer also has a plurality of planar openings.

5. A papermaking press felt as claimed in claim 1, wherein said rewetting prevention layer comprises a material which has extension characteristics substantially the same as those of said base body or said batt layer.

6. A papermaking press felt as claimed in claim 5, in which the rewetting prevention layer also has a plurality of planar openings.

7. A papermaking press felt which has a wet paper web contacting surface and a roll contacting surface, comprising a base body, a batt layer, and a rewetting prevention layer, in which said rewetting prevention layer has three-dimensional passages, each said passage comprises an opening rim, a wet paper web side opening and a roll side opening, said wet paper web side opening being larger than said roll side opening, and in which said rewetting prevention layer comprises a biaxially oriented film.

8. A papermaking press felt as claimed in claim 7, in which the rewetting prevention layer also has a plurality of planar openings.

* * * * *